US007377219B2

(12) United States Patent
Brandt

(10) Patent No.: US 7,377,219 B2
(45) Date of Patent: May 27, 2008

(54) SPIKE-TYPE RAILCAR MOVER WITH OPTIONAL GATE OPENER

(75) Inventor: Calvin J. Brandt, Delano, MN (US)

(73) Assignee: Calbrandt, Inc., Delano, MN (US)

( * ) Notice: Subject to any disclaimer, the term of this patent is extended or adjusted under 35 U.S.C. 154(b) by 349 days.

(21) Appl. No.: 11/347,772

(22) Filed: Feb. 3, 2006

(65) Prior Publication Data

US 2007/0181032 A1 Aug. 9, 2007

(51) Int. Cl.
*B61J 3/08* (2006.01)

(52) U.S. Cl. ..... 104/162; 104/172.3; 104/176

(58) Field of Classification Search ..... 104/162, 104/172.1, 172.3, 172.5, 176
See application file for complete search history.

(56) References Cited

U.S. PATENT DOCUMENTS 3,695,185 A * 10/1972 Rose ..... 104/176
4,006,691 A 2/1977 Kacir et al.
4,354,792 A 10/1982 Cornish
4,633,784 A * 1/1987 Hoehn et al. ..... 104/162
5,709,153 A * 1/1998 Brandt ..... 104/162
6,267,059 B1 7/2001 Brandt
6,553,916 B2 4/2003 Goldbeck
6,837,168 B1 1/2005 Goldbeck et al.

* cited by examiner

*Primary Examiner*—Lars A Olson
(74) *Attorney, Agent, or Firm*—Nikolai & Mersereau, P.A.; C. G. Mersereau

(57) ABSTRACT

A single-carriage reversing train positioning system which includes an extending spike-type car engaging member for engaging and moving one or more railcars. An extending chuck assembly may be provided with the ability to operate gates in bottom-discharging railcars. The system uses a single self-propelled carriage with an on-board carriage drive system that includes a drive motor which operates the car along a fixed chain situated along a guideway. A generally horizontally disposed, laterally extendable pin car-engaging assembly is mounted on the car-moving carriage for aligning with and engaging a hook loop on a railcar for moving the car. A gate-operating assembly which includes a laterally extendable chuck system which aligns with, engages and rotates gate-operating capstans on bottom discharging railcars may also be provided.

28 Claims, 11 Drawing Sheets

SPIKE-TYPE RAILCAR MOVER WITH OPTIONAL GATE OPENER

BACKGROUND OF THE INVENTION

I. Field of the Invention

The present invention relates generally to train positioning systems, particularly to systems for indexing a coupled string or trip of railcars through a work station, to position one or more cars with precision for loading, unloading, washing (etc.) operations. More specifically, the present invention is directed to a system of the class which includes a single self-propelled carriage that operates along a guideway alongside and parallel to a railroad track using an on-board drive that moves the carriage along a single drive chain mounted along the guideway. The carriage uses a single car-engaging device to engage hook loops or hook holes to move the cars along through the work station. The car-engaging device is a horizontally extending cantilevered spike or pin designed to telescope from one side of a car to engage the hook opening. A telescoping gate-opening tool may also be mounted on the carriage for operating gates in bottom discharge cars.

II. Related Art

Uni-Trains, many containing 100 or more cars of identical or a variety of sizes and types, have long been acknowledged as desirable and efficient carriers of bulk raw materials such as coal, iron ore, limestone, various finely divided dry bulk agricultural products including grains, etc., and liquid or dry chemicals. These cars are typically filled from above and may be emptied using a rotary car dumper in the case of coal or iron ore. Liquid bulk cargo is typically unloaded by connecting outlets to large hoses with associated pumping equipment and opening bottom drain valves.

Cars shipping bulk agricultural products are bottom emptied into stationary pits. These cars are provided with a number of spaced bottom discharging hopper bins accessing the main storage volume of the car. These hoppers are closed by horizontal slide gates. When the hoppers are precisely positioned over fixed recessed receiving facilities beneath the railroad track, the gates are opened and the cargo discharged.

In the bottom discharge operation, a connected train engine roughly positions one end of a string of cars to be unloaded close to the unloading facility. However, train engines are not well suited for indexing or precisely positioning individual cars or even sets of cars along the track. Because of this, train positioning devices known as railroad car indexers or movers have been built and operated at fixed stations along the tracks to more precisely position cars for loading or unloading operations.

Railroad car indexers of the class typically include at least one car engaging and propelling member or "dog" for engaging a car in a string or trip of cars and moving the string a given distance along the railroad track. The car-engaging members often situated and operated along an auxiliary indexer track or guideway juxtaposed in parallel relation to the railroad track. Fluid operated actuators such as hydraulic cylinders or chains and sprockets driven by hydraulic or electric motors supply the force for moving railcars. U.S. Pat. No. 4,006,691, issued to Kacir et al, and U.S. Pat. No. 4,354,792, issued to Cornish, show train positioners that approach the train from alongside the track and including an engaging member arm which engages a car coupler from above.

It is known to provide a train positioning system having one or more carriages which include a pair of horizontally pivoting dogs mounted in opposed spaced relation and adapted to operate on a bogey frame such that a first dog engages and pushes on a bogey frame in a first direction and a second opposed dog engaged to push on the bogey frame in the opposite direction. Such a system is illustrated and described in U.S. Pat. No. 6,267,059 to Brandt, a co-inventor in the present application.

Dog-carrying, train-positioning carriages have been proposed using reversing chain drives which include an over/under or vertical sprocket drive system in which the gears and chain are at least partially enclosed to reduce exposure of the mechanism to the elements and the buildup of foreign materials. A system such as this is illustrated and described in U.S. Pat. No. 6,553,916 B2. A further patent, U.S. Pat. No. 6,837,168, discloses a train positioning system that includes a dog carriage having a drive motor mounted on the dog carriage which operates to propel the dog carriage back and forth along a single tension chain in a carriage guideway provided alongside the track. The carriage is supplied with electric power and hydraulic fluid from an attached flexible power track system.

Railroad cars having bottom discharge hopper-type bodies include spaced aligned hoppers which are closed by horizontally disposed gates that are displaced laterally to open and close the bottom of each hopper by drive systems that typically include a rack and pinion mechanism operated by rotating an associated operating rod using an attached capstan. This requires a separate operation utilizing a powered gate operator in which a key or gripper device is used to attach to and rotate each of the capstans. This function has long involved the provision of a separately supplied cantilevered gate operator device utilizing a telescoping chuck to engage a capstan of a railroad car gate. The gate operators are typically separately mounted to operate along their own gate operator platform spaced from, but associated with, a railcar indexing system.

While many of these prior systems have met with success, a need has also existed to simplify cantilever car-engaging systems and to optionally incorporate a gate operating device on the same carriage which carries the car-engaging member. Accordingly, the present invention provides a single telescoping body pin or spike-type car-engaging assembly mounted on a car-moving carriage which engage railcars using the hook loops or holes and also may incorporate a gate-operating assembly mounted on the same carriage. The carriage incorporates on-board drive and hydraulic systems and operates along a guideway using a single strand of drive chain.

SUMMARY OF THE INVENTION

By means of the present invention, there is provided a body pin reversing train positioning indexer system that includes a single self-propelled carriage carrying a single cantilevered extending, spike-type car-engaging member or a combination of devices for addressing railroad cars which includes a bottom gate-operating chuck assembly. An operator station is also mounted on the single carriage which is designed to operate back and forth along the length of a carriage guideway spaced alongside and parallel to a segment of railroad track.

The carriage-mounted car-moving assembly of the train positioning system of the invention includes a generally horizontally disposed, cylinder-operated, laterally extendable body pin or spike-type car-engaging member mounted on the car-moving carriage which extends to engage a hook loop or hook hole on a railroad car. The car and all cars attached to it are moved by moving the carriage. Once the car is positioned, the carriage is stopped and the spike-type dog optionally retracted. A gate-operating chuck assembly may also be mounted on the car-moving carriage spaced from the car-moving spike assembly.

In the detailed embodiment, an optional gate-operating chuck assembly is shown that includes a laterally extendable chuck system for engaging and rotating gate-operating capstans on bottom discharging railroad cars. Once a car of interest is positioned and the pin member retracted, the carriage can again be moved to position a laterally extruding gate-operating chuck to sequentially open the bottom gates of the car. Both the car-engaging pin or spike and the gate-operating chuck have the ability to be raised and lowered relative to the carriage and so can be adjusted to engage any hook hole or capstan as the case may be.

A carriage drive system is provided which includes a drive motor mounted on the car-moving carriage. The drive motor is preferably a conventional reversing hydraulic motor with associated drive unit which operates a rotating output sprocket or gear which, in turn, operates the carriage along a single strand of drive chain situated along or in the carriage guideway. Chain tension is controlled by a slack take-up system which includes a movable idler gear or sprocket controlled by a hydraulic cylinder in a manner such that extending the cylinder rod increases tension on the chain and retracting the rod lowers tension. The cylinder is designed to retract far enough to allow a chain to be easily removed or installed as needed.

A flexible power supply system attached to move with the carriage is used to supply operating power to the system. Preferably, an entire self-contained hydraulic system is also mounted on the carriage or hydraulic fluid may be supplied to the carriage along with the operating power through the flexible power track system by fixing the end of the track to a source of high pressure and return lines from a stationary hydraulic power unit.

Hydraulic cylinders are preferably utilized to raise and lower the spike-type car-engaging dog and capstan operating chuck and to operate telescoping boom systems to extend and retract these devices. In this manner, the dog assembly is mounted on a generally vertically pivoting stabilizing frame, the height of which is adjusted utilizing additional hydraulic cylinders. Both the mounting frame and telescoping car-engaging pin or spike system must be of a very heavy construction owing to the force necessary to be applied in cantilever fashion to a car or trip of cars. This force may be as much as 50,000 pounds.

BRIEF DESCRIPTION OF THE DRAWINGS

In the drawings wherein like reference characters depict like parts throughout the same.

DETAILED DESCRIPTION

Figure 1A:
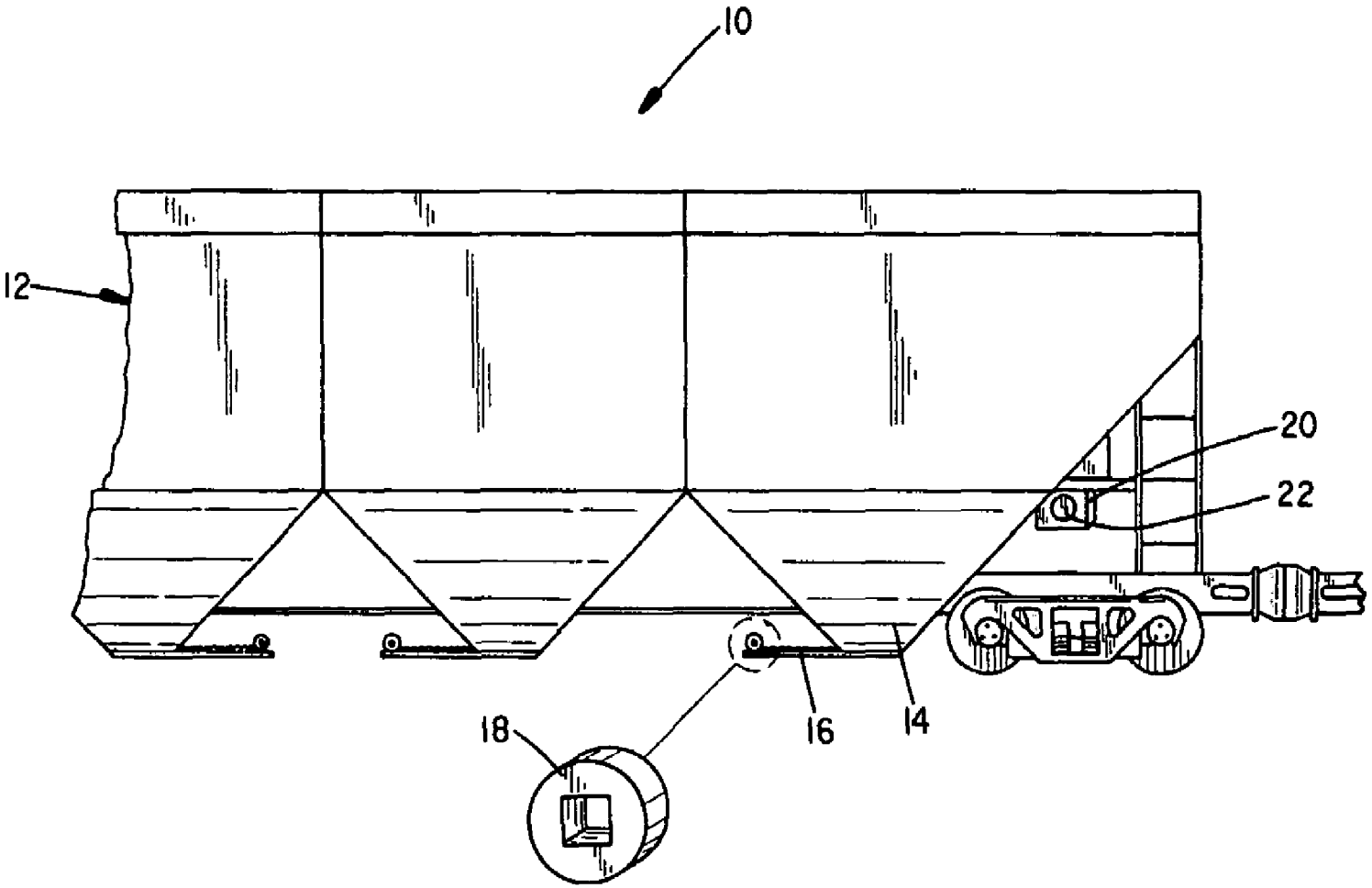
FIG. 1*a* is a fragmentary side elevational view of a railcar of a type for which the present invention is designed to be used.

In accordance with describing the detailed embodiments of the invention illustrated in the drawings, it should be noted that the detailed descriptions are intended by way of example only and are not intended to limit the scope of the invention in any respect. The embodiments of the invention can be modified by those skilled in the art while remaining in keeping with the inventive concepts.

An important aspect of the train positioning system of the present invention lies in the use of a single extending body pin or spike-type hook loop engaging car moving member. Another aspect involved is an embodiment that includes a combination of coordinated railcar-attending devices. The positioning system of the invention functions as a self-contained, self-propelled, single-car carriage positioning system which includes an on-board operator and control module. A detailed embodiment will next be described with reference to the drawing figures.

Figure 1B:
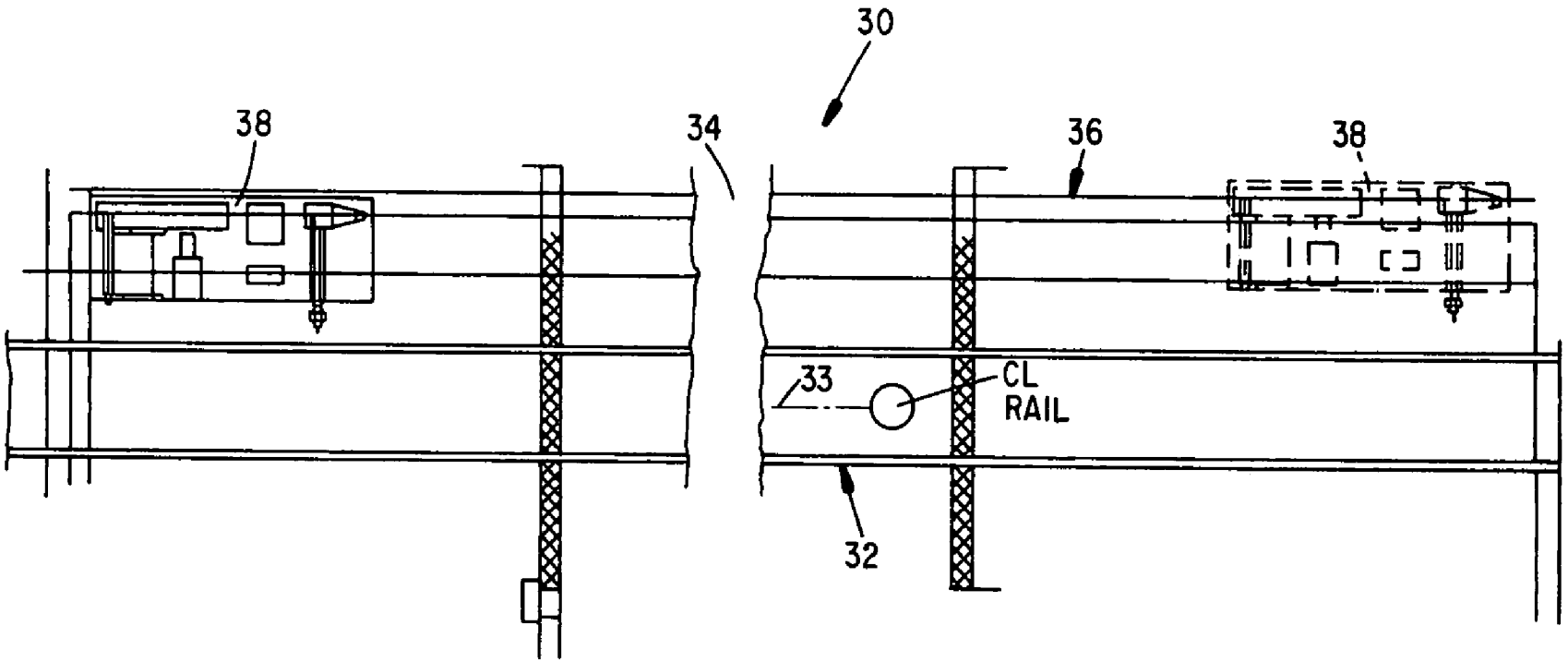
FIG. 1*b* is a broken schematic top or plan view of a railcar positioning system layout in accordance with the invention showing a carriage in two positions.

FIG. 1*a* is a fragmentary view of a bulk cargo, bottom-discharging railcar 10 having a bulk cargo hold 12, a plurality of discharge chutes as at 14 with rack and pinion-operated gate 16 with rotating capstans, one of which is shown enlarged at 18 and hook loop or hook hole car-moving devices 20 with opening able to receive a spike-type car-moving member therein at 22. FIG. 1*b* is a broken schematic plan view of a single carriage train positioning system in accordance with the present invention generally represented by 30 and includes a section of track 32 encompassing the length of the car mover system with centerline 33, shown broken at 34. A guideway 36 is positioned parallel to and spaced a short distance from the track and a car-moving carriage 38 is shown in two extreme positions at the ends of the section of track 32.

Figure 2:
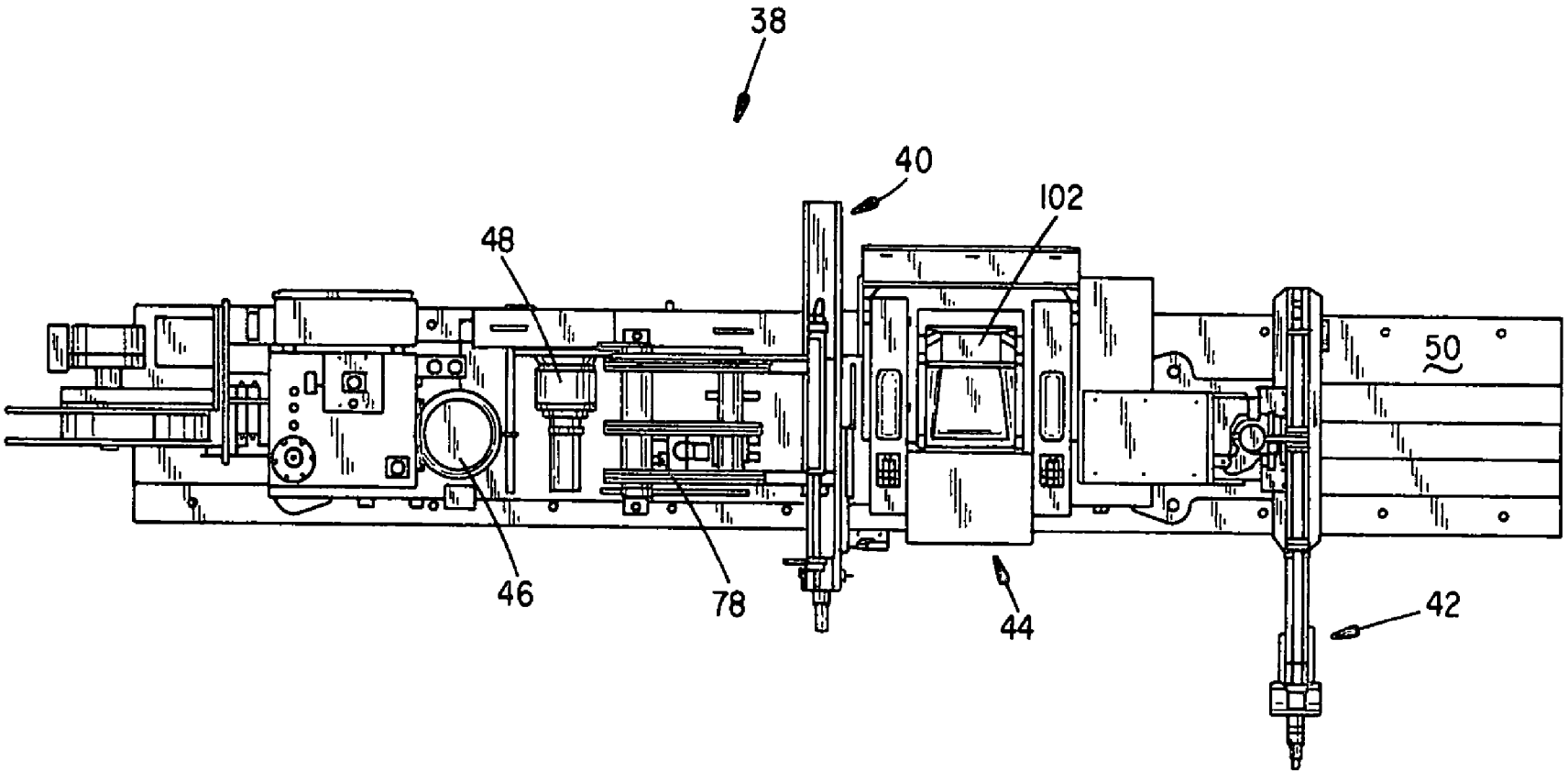
FIG. 2 is a schematic top view of a car-moving carriage in accordance with the invention.
Figure 3:
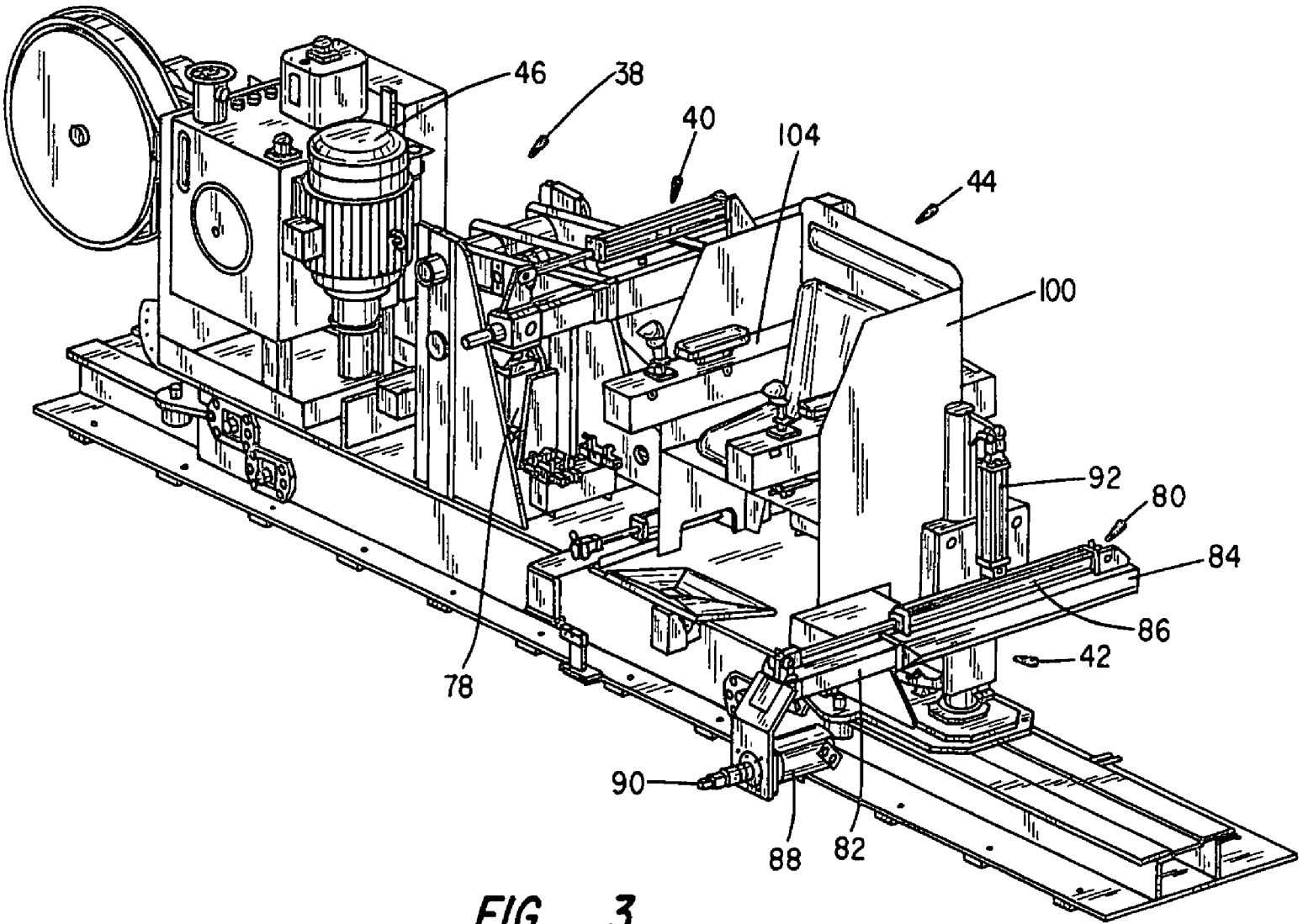
FIG. 3 is an enlarged front perspective view of the car-moving carriage of FIG. 2.
Figure 4:
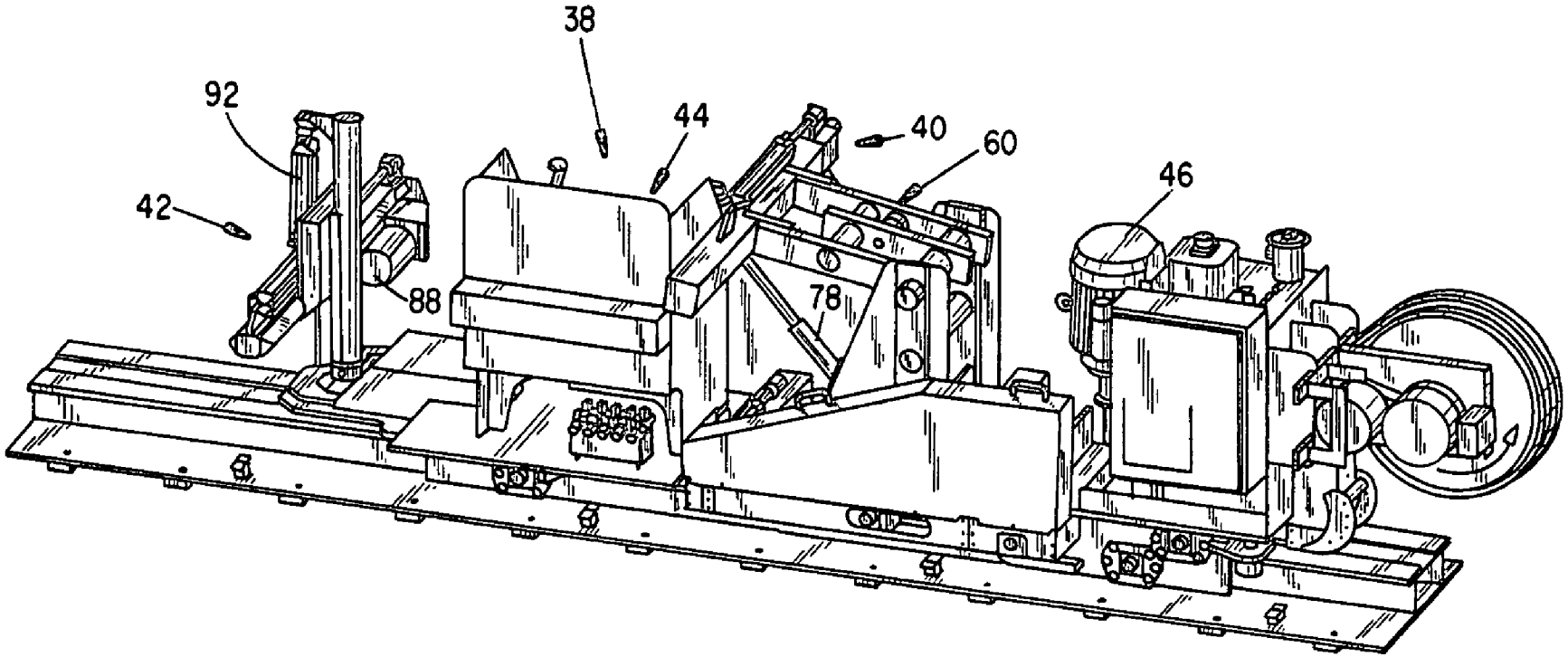
FIG. 4 is a rear perspective view of the car-moving carriage of FIG. 2.

FIGS. 2-4 depict respectively a top or plan view and perspective views of the car-moving carriage 38 including a generally horizontally disposed car-moving member assembly 40, a gate-operating chuck assembly module 42 and an operator control module 44. An electric motor for powering a hydraulic system for the car-moving carriage is shown at 46 and a hydraulic drive motor for driving the carriage at 48. The drive system is depicted in greater detail in FIGS. 5-6. The carriage further includes a platform 50 on which the other assemblies are mounted.

Figure 8:
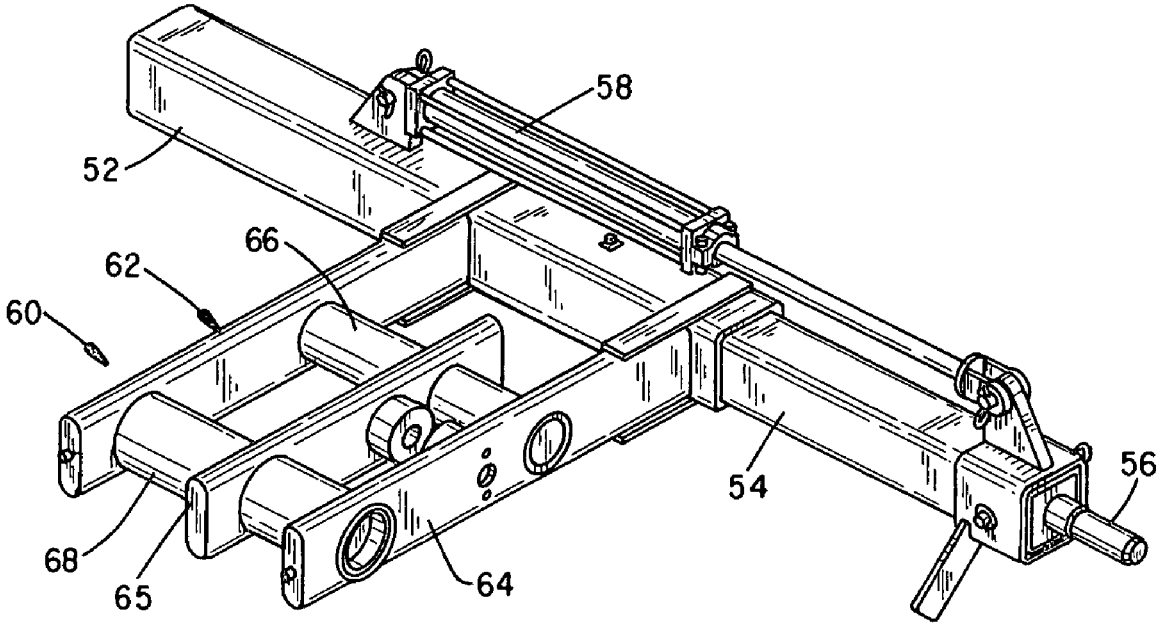
FIG. 8 is a perspective view of part of a car-moving spike-type dog assembly in accordance with the invention.

As can be seen from the figures, particularly the detailed view of FIG. 8, the car-engaging dog assembly 40 includes a telescoping arrangement that has an outer member 52 and an extending inner member 54 which, in turn, carries a pin or spike-type member 56. The telescoping system is operated by a double-acting hydraulic cylinder shown at 58 which is connected between hollow outer member 52 and inner member 54. Outer member 52 of the telescoping arrangement is mounted in a heavy stabilizing frame 60 which is best pictured assembled in FIG. 4. The frame 60 includes stationary and pivoting portions, the pivoting portion allows vertical adjustment of the telescoping assembly and with it the spike-type member 56 and includes a pair of spaced side members 62 and 64 connected at one end to member 52 and central shorter member 65 spaced by connectors at 66 and 68. The connector 68 is pivotally mounted on a shaft as at 70 in stationary side plates 72 and 74 which are fixed to the carriage platform 50. A further stabilizing connecting member is provided between the plates 72 and 74 at 76. A pair of spaced hydraulic cylinders as at 78 are connected to pivot side plates 60 and 62 and thereby pivot the assembly 60 to raise and lower the telescoping arrangement as desired. It should be noted that the construction of the car-engaging dog assembly must be extremely heavy as maximum force required to move a trip of cars may be as high as 50,000 pounds. Typical operating speeds for moving cars by the system of the invention is between 0-250 feet per minute depending on the load and other circumstances.

Figure 10:
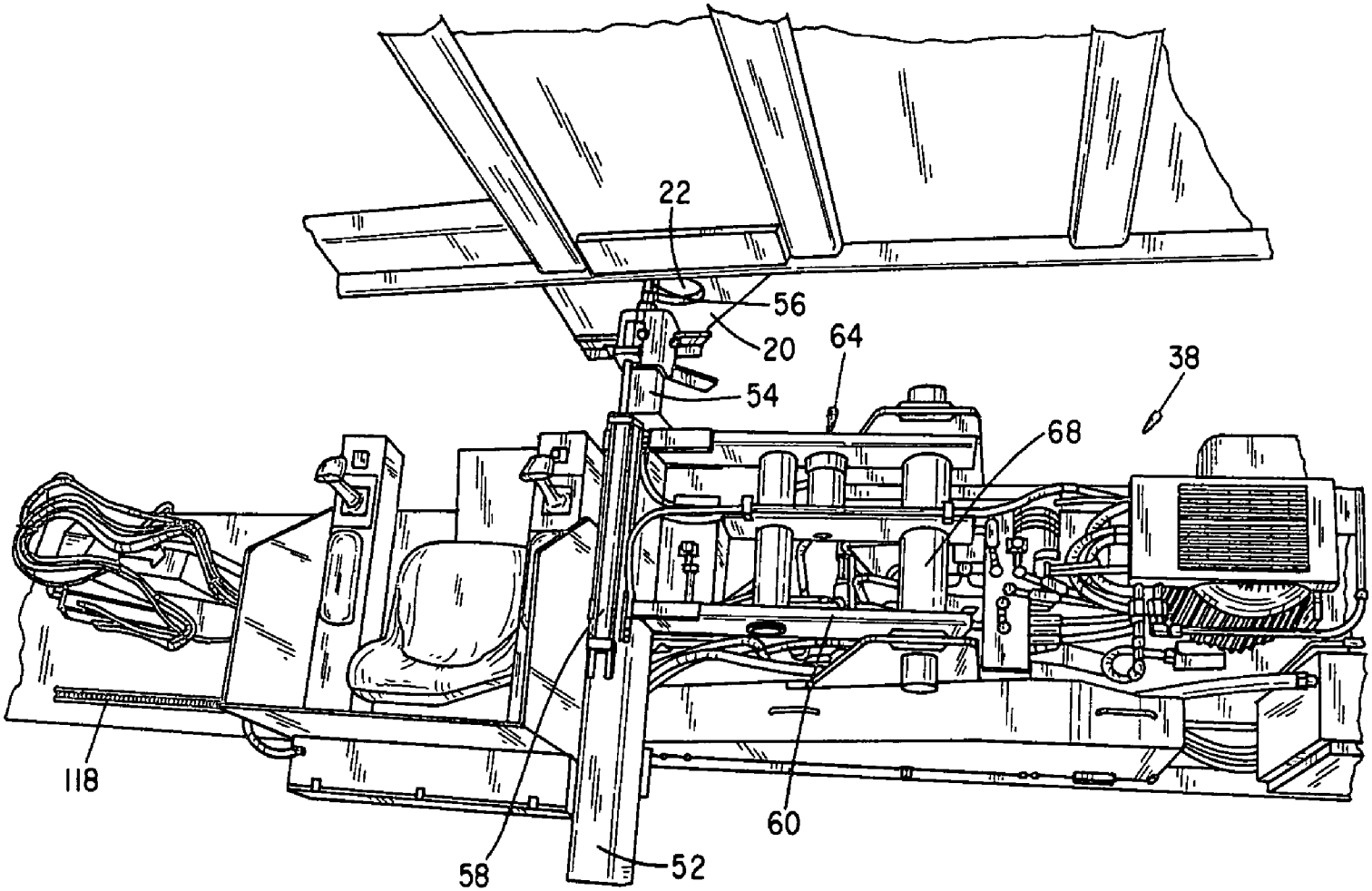
FIG. 10 is a fragmentary side perspective view depicting a gate-operating chuck in accordance with the invention in use.

The gate-operating assembly module 42 includes a generally horizontally disposed telescoping assembly 80 including inner and outer members 82 and 84 and an operating cylinder 86 connected therebetween. Inner member 82 further carries a reversible hydraulic motor 88 which rotates a gate-operating chuck 90 which is designed to fit into a recess and turn a corresponding capstan as at 140 (FIG. 10) on the gate of a bottom unloading railcar as at 142. Vertical adjustment of the telescoping system 80 is accomplished using a sliding mount and a generally vertically mounted cylinder 92. A gate operator of the type illustrated is commercially available, for example, as a HA 1800T gate opener from Calbrandt, Inc. of Delano, Minn., as an independent system.

The operator control module 44 includes a frame 100 containing an operator seat 102 from which a set of controls 104 is easily accessible. The module is situated so that an operator, when positioned in the seat, faces toward the railcars so that he/she may precisely position both the car-engaging pin or spike 56, and so a car engaged by the pin or spike 56 and alternatively, the gate-operating chuck 90 as desired.

Figure 5:
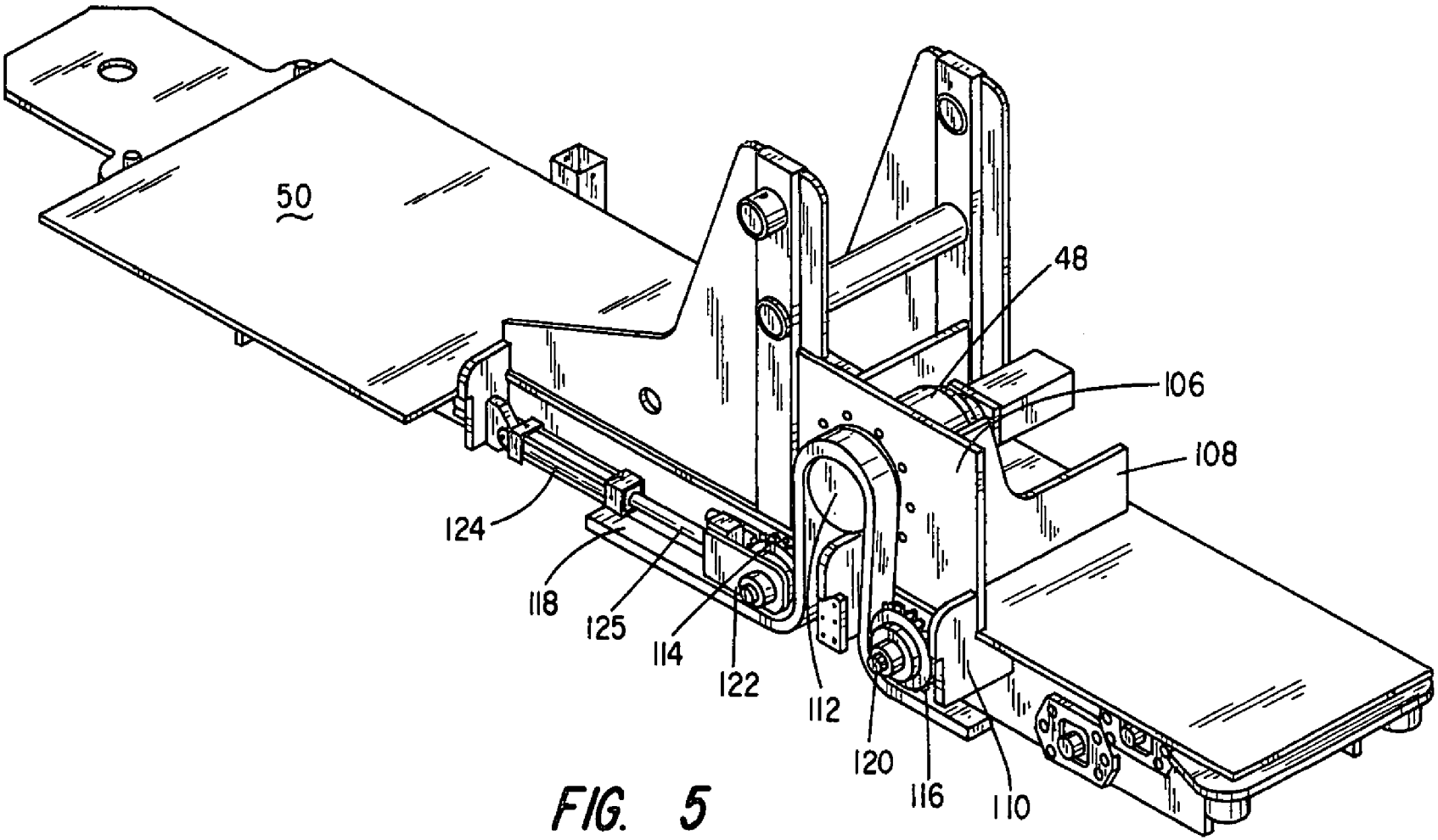
FIG. 5 is a schematic perspective view of a car-moving carriage of the invention with parts removed to show the drive arrangement for the carriage.
Figure 6:
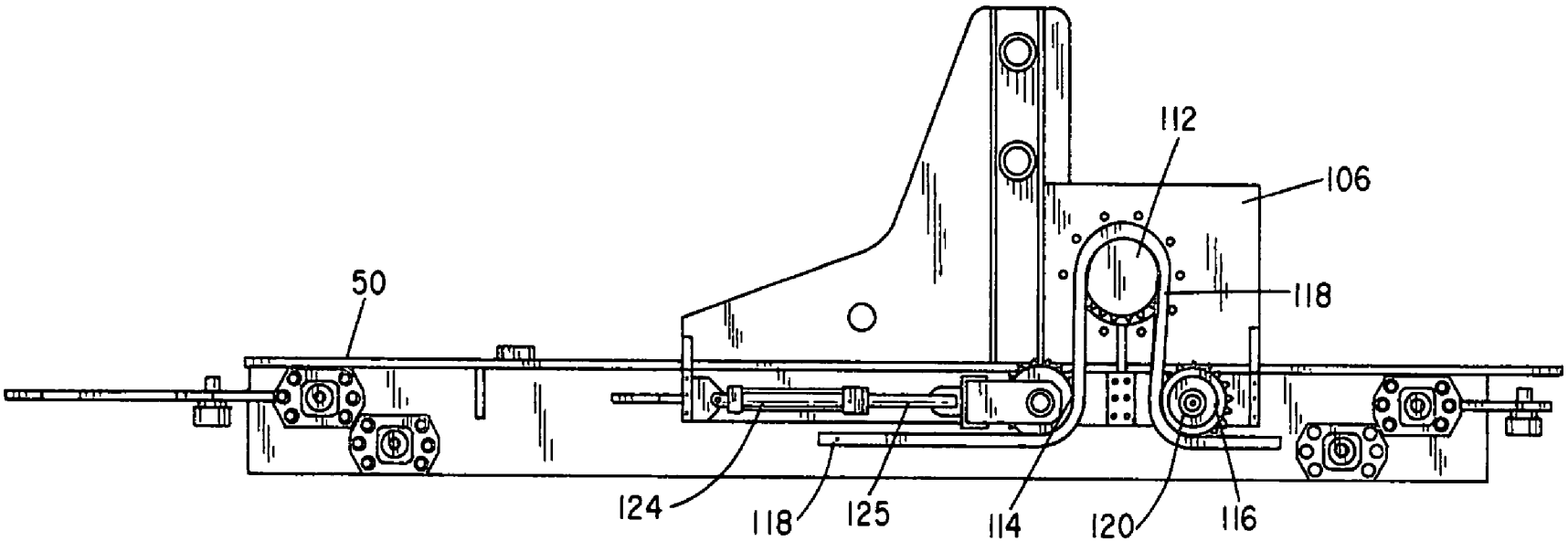
FIG. 6 is a side elevational view of the drive arrangement of FIG. 5.

As shown in FIGS. 5 and 6, the carriage 38 further is equipped with its own self-propelling drive system which includes a reversing hydraulic motor 48 mounted to a plate 106 buttressed by plates 108 and 110 and having an output shaft carrying an associated output gear or sprocket 112. The output sprocket or drive gear 112 is associated with a pair of spaced idler gears or sprockets 114 and 116 which, with the output sprocket or gear 112, engage a heavy single strand drive chain shown as a solid member fragment at 118. Idler sprocket or gear 116 is shown in a fixed mount at 120, whereas idler gear or sprocket 114 is mounted as a movable or take-up sprocket at 122. Chain tension is controlled by a double-acting hydraulic cylinder 124 with rod 125 which operates to position and control the force on the idler sprocket or gear 114 and with it, the tension on chain strand 118. Chain 118 is fixed in the guideway and operation of the motor 110 causes the carriage 38 to move along the fixed chain 118 and the guideway as desired.

Figure 7:
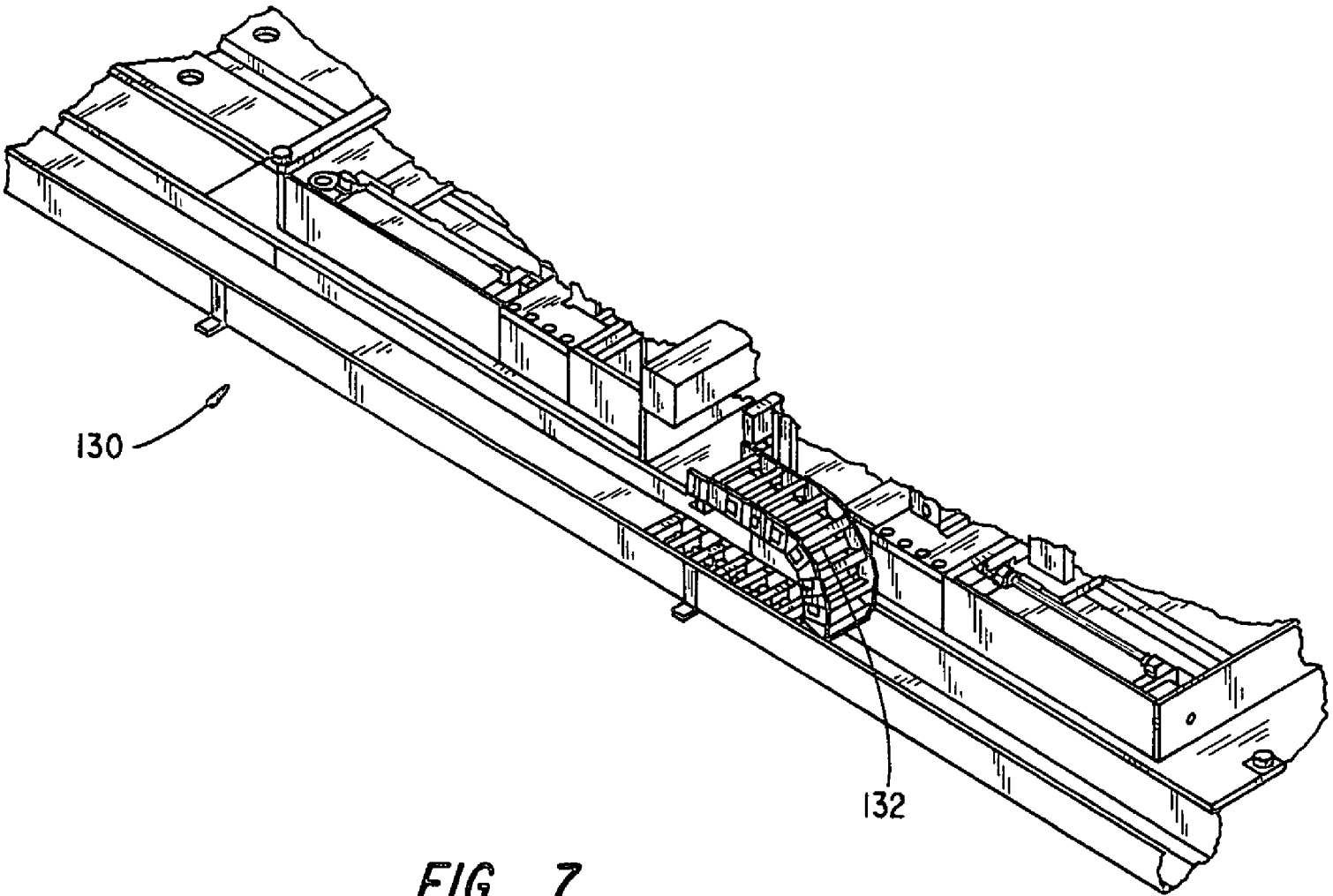
FIG. 7 is a fragmentary perspective view showing part of a guideway and a portion of a connected flexible track supply system.

FIG. 7 depicts a fragment of a carriage 130 showing a section of a flexible power supply at 132 which is attached to move with a carriage and supply operating power to the system. If desired, this system can also carry both a pressurized hydraulic line and a hydraulic drain line as an alternative to a self-contained hydraulic unit being carried on the carriage itself.

Position sensors and safety or operating interlocks may be provided for the pin deploying or car-engaging and gate-operating assemblies so that the carriage cannot be advanced when the gate-operator chuck is extended and the gate-operator chuck cannot be extended until the car-engaging pin is retracted, etc. These are conventional and may be accomplished in a well-known manner.

Figure 9:
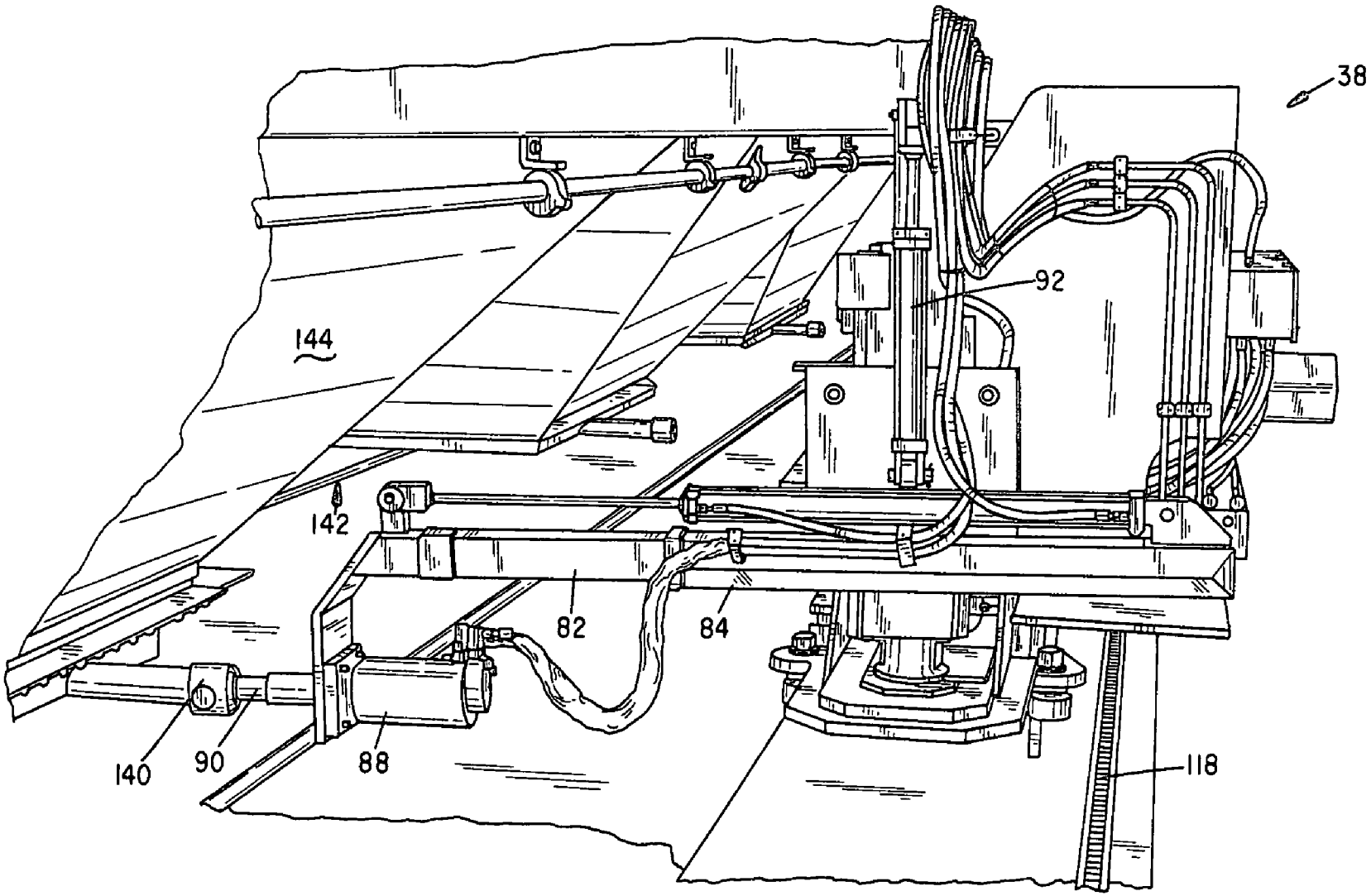
FIG. 9 is a fragmentary, top perspective view depicting a spike-type car engaging member of the invention engaging a railway car.

In operation, the train positioning aspect of the operation of the positioning system of the invention includes aligning the spike-type member 56 with a hook loop opening on an adjacent railcar and utilizing the telescoping system to advance the spike or pin into the loop for advancing one or more cars as at 150 (as shown in FIG. 9). The carriage is moved until a car of interest is properly positioned for loading or discharge. The discharge is accomplished by then aligning and extending the gate-operating chuck assembly into the desired capstan and operating the capstan-operating chuck 90 with a gate capstan as at 140 (FIG. 10) and thereafter rotating the chuck to open the gate. This allows discharge of the contents of the connected hopper bin section as at 144 and then the gate is returned to the closed position by reversing the rotation of the chuck. Sequentially, all the gates in a car can be opened and closed until the car is unloaded. This all can be accomplished readily by a single operator seated on the carriage utilizing hand controls to align and advance both the car-moving pin member and the gate-operating chuck.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A reversing train positioning system for engaging and positioning one or more railcars comprising:

(a) a carriage guideway spaced alongside and parallel to a railroad track;

(b) a car-moving carriage mounted to operate along said guideway;

(c) a carriage operating system for operating said car-moving carriage along said guideway;

(d) a generally horizontally disposed, linearly laterally extendable car-engaging assembly mounted on said car-moving carriage for engaging a hook loop on a railcar.

2. A train positioning system as in claim 1 wherein said car-engaging assembly includes a car-engaging pin carried by a telescoping, laterally reciprocating pin deploying system for advancing and retracting said engaging pin to engage and release railcars.

3. A train positioning system as in claim 2 wherein said pin deploying system further comprises a cylinder-operated extending inner member nested in a hollow outer member.

4. A train positioning system as in claim 2 wherein said car-engaging arrangement further includes a system for adjusting the relative height of said pin deploying system.

5. A train positioning system as in claim 4 wherein said system for adjusting the height of said car-engaging deploying system further includes a generally vertically pivoting stabilizing frame and a frame actuating system.

6. A train positioning system as in claim 5 wherein said frame actuating system includes linear actuators for pivoting said frame and adjusting the height of said pin.

7. A train positioning system as in claim 6 wherein said frame actuating system includes a pair of spaced hydraulic cylinders.

8. A train positioning system as in claim 1 wherein said carriage operating system comprises a drive motor mounted on said carriage.

9. A train positioning system as in claim 8 wherein said carriage operating system comprises a single strand of chain mounted along said guideway engaged by gears driven by said motor.

10. A train positioning system as in claim 9 wherein said carriage drive system further comprises a chain tension control system for controlling tension in said drive chain.

11. A train positioning system as in claim 10 wherein said tension control system further comprises a take-up system comprising a cylinder-operated position adjustable idler sprocket carried by said carriage.

12. A train positioning system as in claim 1 further comprising a flexible power supply system attached to move with said carriage and supply operating power thereto.

13. A train positioning system as in claim 12 wherein said carriage drive system comprises a single fixed chain strand engaged by gears or sprockets driven by said motor and a take-up and tension control system comprising a cylinder-operated idler gear or sprocket.

14. A train positioning system as in claim 1 wherein said carriage further comprises an operator control module for on-board operation of the train positioning system.

15. A train positioning system as in claim 13 wherein said carriage further comprises an operator control module for on-board operation of the train positioning system.

16. A train positioning system as in claim 12 wherein said carriage operating system comprises a drive motor mounted on said carriage.

17. A reversing train positioning system for engaging and moving one or more railcars and operating gates in bottom-discharging railcars comprising:

(a) a carriage guideway spaced alongside and parallel to a railroad track;

(b) a car-moving carriage mounted to operate along said guideway;

(c) a carriage operating system for operating said car-moving carriage along said guideway;

(d) a generally horizontally disposed, linearly laterally extendable car-engaging assembly mounted on said car-moving carriage for engaging a hook loop on a railcar; and (e) a gate-operating assembly mounted on said car-moving carriage, said gate-operating assembly including a laterally extendable chuck for engaging and rotating gate-operating capstans on bottom discharging railcars.

18. A train positioning system as in claim 1 wherein said car-engaging assembly includes a car-engaging pin carried by a telescoping, laterally reciprocating pin deploying system for advancing and retracting said engaging pin to engage and release railcars.

19. A train positioning system as in claim 18 wherein said car-engaging arrangement further includes a system for adjusting the relative height of said pin.

20. A train positioning system as in claim 17 wherein said carriage operating system comprises a drive motor mounted on said carriage.

21. A train positioning system as in claim 17 further comprising a flexible power supply system attached to move with said carriage and supply operating power thereto.

22. A train positioning system as in claim 21 wherein said carriage operating system comprises a drive motor mounted on said carriage.

23. A train positioning system as in claim 20 wherein said carriage drive system comprises a single strand of chain mounted along said guideway engaged by gears driven by said motor.

24. A train positioning system as in claim 23 wherein said carriage drive system further comprises a chain tension control system for controlling tension in said drive chain.

25. A train positioning system as in claim 24 wherein said tension control system further comprises a take-up system comprising a cylinder-operated position adjustable idler sprocket carried by said carriage.

26. A train positioning system as in claim 22 wherein said carriage drive system comprises a single fixed chain strand engaged by gears or sprockets driven by said motor and a take-up and tension control system comprising a cylinder-operated idler gear or sprocket.

27. A train positioning system as in claim 17 wherein said carriage further comprises an operator control module for on-board operation of the train positioning system.

28. A train positioning system as in claim 26 wherein said carriage further comprises an operator control module for on-board operation of the train positioning system.

* * * * *